United States Patent [19]

Narusawa et al.

[11] 4,352,877

[45] Oct. 5, 1982

[54] ELECTROPHOTOGRAPHIC DEVELOPING PROCESS USING FLASH FIXATION AND TONER THEREFOR

[75] Inventors: Toshiaki Narusawa, Sagamihara; Seiji Okada, Kawasaki; Kiyohide Muramatsu, Tokyo; Teruo Yagishita, Yokohama; Hirohumi Okuyama, Sagamihara, all of Japan

[73] Assignee: Fujitsu Limited, Kawasaki, Japan

[21] Appl. No.: 253,837

[22] PCT Filed: Aug. 20, 1980

[86] PCT No.: PCT/JP80/00187

§ 371 Date: Apr. 22, 1981

§ 102(e) Date: Apr. 21, 1981

[87] PCT Pub. No.: WO81/00628

PCT Pub. Date: Mar. 5, 1981

[30] Foreign Application Priority Data

Aug. 22, 1979 [JP] Japan ..... 54-105954

[51] Int. Cl.[3] ..... G03G 13/12

[52] U.S. Cl. ..... 430/97; 430/124; 430/109

[58] Field of Search ..... 430/97, 109, 124

[56] References Cited

U.S. PATENT DOCUMENTS

| | | | |
|---|---|---|---|
| 3,236,639 | 2/1966 | Tomanek | 430/107 X |
| 3,506,469 | 4/1970 | Titow | 430/109 |
| 3,753,910 | 8/1973 | Mitsuhashi et al. | 430/109 X |
| 4,073,739 | 2/1978 | Peters | 430/109 |

*Primary Examiner*—John D. Welsh

*Attorney, Agent, or Firm*—Staas & Halsey

[57] ABSTRACT

An electrophotographic process is provided wherein an electrostatic latent image is developed with finely divided toner particles and then the developed image is fixed by irradiating it with high energy ultraviolet rays or visible light. The toner particles used consist essentially of, based on the weight of the toner particles, (a) 62–99.4 wt. % of a binder resin substantially consisting of a bisphenol A/eplchlorohydrin type epoxy resin having a melting point of 60°–160° C., an epoxy equivalent of about 450–5,500 and a Mw of about 900–8,250, (b) 0.6–8 wt. % of carbon, (c) 0–5 wt. % of a dye and, optionally, (d) 0–20 wt. % of a montanic acid ester wax.

5 Claims, 2 Drawing Figures

ELECTROPHOTOGRAPHIC DEVELOPING PROCESS USING FLASH FIXATION AND TONER THEREFOR

DESCRIPTION

BACKGROUND OF THE INVENTION

This invention relates to an electrophotographic process wherein an image developed with finely divided toner particles is fixed by a flash fixation procedure.

In conventional electrophotographic processes wherein electrophotographic devices such as printers, facsimiles and copiers are utilized, images developed with finely divided toner particles are usually fixed by using an oven or heated roller. However, the finely divided toner particles used in these conventional electrophotographic processes are not suitable for a process wherein developed images are fixed by means of flash fixation. The term "flash fixation" as used herein means a fixation procedure wherein a toner image is fixed by irradiating the toner image with high energy ultraviolet or visible light to instantly elevate the temperature of the toner to a point at which the toner is molten.

Most of the conventional finely divided toner particles comprise resin binders which are based upon styrene/acrylic acid ester copolymers, as described in, for example, Japanese Laid-open Patent Applications Nos. 17,434/72, 17,435/72, 8,141/73, 16,646/73, 75,033/73, 78,936/73, 79,639/73, 90,238/73, 90,132/74, 44,836/75 and 23,941/77. If the styrene/acrylic acid ester copolymer-based toners are used in an electrophotographic process wherein the developed toner images are fixed by means of flash fixation, the styrene/acrylic acid ester copolymer tends to be degraded, namely, the main chain of the styrene/acrylic acid ester copolymer tends to be broken at the ester bond portions, thereby producing low molecular weight substances such as styrene, xylene, isopropylbenzene, butanol, isobutyl acetate, methyl methacrylate and butyl methacrylate.

Furthermore, most of the conventional finely divided toner particles contain, as a colorant, carbon and various organic dyes. Particularly, some commercially available toners contain only an organic dye as a colorant. Typical organic dyes used include, for example, heavy metal-containing acid dyes and Nigrosine base dyes. The heavy metal-containing acid dyes have a problem in that the heavy metal contained therein is toxic. The Nigrosine base dyes have a problem in that, when the developed toner images are fixed by means of flash fixation, the dyes tend to produce low molecular weight substances, such as nitrobenzene, aniline and biphenylamine, due to the decomposition of the dyes.

In other words, when the conventional finely divided toner particles are used in an electrophotographic process wherein the developed toner images are fixed by means of flash fixation, the toner particles produce gaseous, low molecular weight substances which emit an offensive odor and are detrimental to health.

SUMMARY OF THE INVENTION

It is, therefore, a primary object of the present invention to provide an electrophotographic process wherein the developed toner images are fixed by means of flash fixation, during which fixation only a minimal amount of gaseous low molecular weight compounds emitting an offensive order is produced.

In accordance with the present invention, there is provided an improved electrophotographic process for developing an electrostatic latent image with finely divided toner particles and fixing the developed image by irradiating it with a high energy ultraviolet or visible light, characterized by using as the toner particles those which consist essentially of, based on the weight of the toner particles, 0.6 to 8% by weight of carbon as a colorant and 0 to 5% by weight of a dye as a colorant, and 62 to 99.4% by weight of a binder resin; at least 95% by weight of said binder resin being a bisphenol A/epichlorohydrin type epoxy resin having a melting point of from 60° to 160° C., an epoxy equivalent of from about 450 to about 5,500 and a weight average molecular weight of from about 900 to about 8,250.

DESCRIPTION OF THE PREFERRED EMBODIMENT

Figure 1:
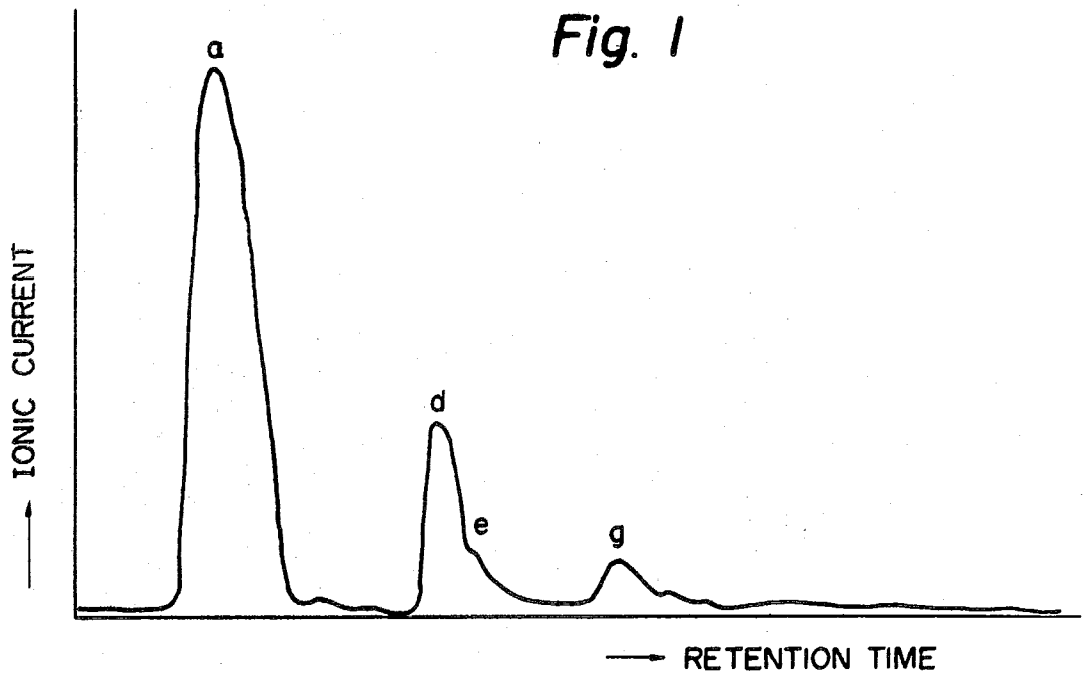
FIG. 1 illustrates a gas chromatogram of a gaseous mixture evolved when an image developed with the toner of the present invention is fixed by means of flash fixation.

The entirety or at least 95% by weight of the binder resin contained in the finely divided toner particles consists of the above-specified bisphenol A/epichlorohydrin type epoxy resin. One or more other resin binders may be used in combination with the bisphenol A/epichlorohydrin type epoxy resin for the purpose of, for example, modifying antistatic properties. The amount of such resin binders should be not more than 5% by weight based on the total weight of the resin binders. The above-specified bisphenol A/epichlorohydrin type epoxy resin has a molecular structure which is very stable with respect to high energy ultraviolet light exposure, and thus, even when the epoxy resin is exposed to the ultraviolet light, no offensive and harmful gases are generated.

The bisphenol A/epichlorohydrin type epoxy resin used should not be blocked at room temperature, and should be readily and rapidly melted when exposed to a flash light of a moderate intensity. For these requirements, the bisphenol A/epichlorohydrin type epoxy resin should possess a melting point of from 60° to 160° C., preferably from 80° to 120° C., and an epoxy equivalent of from 450 to 5,500 and a weight average molecular weight of from about 900 to about 8,250. As the bisphenol A/epichlorohydrin type epoxy resin, there can be mentioned commercially available epoxy resins such as, for example, Epikote (trade name) 1001, 1004, 1007 and 1009, supplied by Shell Chemical Co.; Araldite (trade name) 6071, 7071, 7072, 6084, 7097, 6097 and 6099, supplied by Ciba-Geigy Co.; D.E.R. (trade name) 660, 661, 662, 664, 667, 668 and 669, supplied by Dow Chemical Co.; and Epiclon (trade name) 1050, 3050, 4050 and 7050, supplied by Dainippon Ink Co. The amount of the bisphenol A/epichlorohydrin type epoxy resin used may be varied in the range of from 62 to 99.4% by weight, based on the weight of the toner particles.

It is preferable that finely divided carbon powder having particles as small as possible occupy the core of each of the finely divided toner particles. The finely divided carbon powder should be present in an amount sufficient for melting the binder resin when the toner particles are exposed to flash light. For this purpose, the amount of the finely divided carbon powder should be at least 0.6% by weight, preferably at least 4% by weight, based on the weight of the toner particles. The maximum permissible amount of the finely divided carbon powder is 8% by weight, preferably 6% by weight, based on the weight of the toner particles. When the amount of the finely divided carbon powder exceeds 8% by weight, the melt fluidity of the finely divided toner particles becomes poor, and thus, a higher fixation temperature, i.e., exposure to a more intense flash light, is needed.

A minor amount of a dye may be incorporated in the finely divided toner particles for the purpose of adjusting the color tone of the toner particles and/or preventing irregular reflection of the flash light on the surface of the toner particle. As the dye a Nigrosine base dye is preferably used. However, the Nigrosine base dye and some of the other organic dyes tend to be decomposed upon exposure to a flash light, as mentioned before. Therefore, the amount of the dye should not exceed about 5% by weight, based on the weight of the toner particles. Preferably the amount of the dye is generally in the range of from 1 to 3% by weight.

It now has been found that, when a minor amount of a montanic acid ester wax is incorporated in the finely divided toner particles, copy quality is improved. That is, even when many copies are repeatedly produced, the image contrast is not significantly reduced, and both fog formation in the background area of each copy and incomplete transfer of the toner image can be minimized. It is presumed that such improvement in the copy quality is due to the fact that a montanic acid ester wax imparts to the toner particles blocking resistance and lubricating properties. The term "montanic acid ester wax" as used herein means a montan wax, the predominant ingredient of which is esters of C20-30 fatty acids including montanic acid (i.e., a monobasic straight chain saturated fatty acid having 28 carbon atoms).

It is preferable that the amount of the montanic acid ester wax used is in the range of from about 1% to about 20% by weight, based on the total weight of the toner particles. When the amount of the montanic acid ester wax is too small, toner particles having the desired blocking resistance and lubricating properties cannot be obtained. In contrast, when the amount of the montanic acid ester wax is too large, undesirable wax films are formed on the surface of the carrier and on the surface of the photosensitive element, and consequently, the charge of electricity fluctuates and the resulting latent image is not satisfactory as the result of fog formed on the copies and incomplete transfer of the toner image.

Furthermore, it has been found that most waxes other than the montanic acid ester wax result in toner particles of poor blocking resistance and poor fixation properties.

If desired, the finely divided toner particles of the present invention may have incorporated therein minor amounts of suitable additives. For example, an electrifying agent, such as polyphenylene-polyamine ("AFP-B"[trade name], supplied by Orient Chemical Industries Co.) may be used in an amount of not more than about 3% by weight, based on the weight of the toner particles.

The finely divided toner particles of the present invention may be prepared by a conventional process wherein the respective ingredients are kneaded together, and the kneaded product is pulverized and classified into the particles of the desired size.

The electrophotographic process, wherein the finely divided toner particles of the present invention are used as a developer, may be conventional. The latent image is developed with the finely divided toner particles of the present invention and the developed toner image is fixed by exposing the toner image to high energy ultraviolet or visible light. For example, the developed toner image may be exposed to flash light emitted from a Xenon flash lamp of 300 to 1,500 j/pulse.

The invention will be further illustrated by the following examples and comparative examples, wherein parts are by weight.

EXAMPLE 1

92 parts of a bisphenol A/epichlorohydrin type epoxy resin having an epoxy equivalent of about 950, a weight average molecular weight of about 2,000 and a melting point of about 100° C. ("Epiclon 4050", trade name, supplied by Dainippon Ink Co.), 5 parts of a finely divided carbon black powder having an average particle size of 24 millimicrons and a nigrometer index of 83 ("Black-Pearls L", trade name, supplied by Cabot Corp.), 2 parts of a Nigrosine base dye ("Nigrosine Black EX", supplied by Orient Chemical Industries Co.) and one part of di-(2-hydroxyethoxyethyl)octadecylamine were kneaded together by using a kneader maintained at a temperature of 100° C. The kneaded product was pulverized by using a jet-pulverizer and, then, classified by using an air classifier.

Using these toner particles, letter copies were produced by a laser printer operating at a printing rate of 16 cm/sec. The printer was fitted with a Xenon flash lamp (supplied by Ushio Electric Co.), whereby the developed toner images were flash-fixed at 300 j/pulse. The flash fixation chamber of the printer was ventilated at the rate of one liter/minute, and gaseous organic substances present in the discharged air were analyzed as follows. The gaseous organic substances were trapped by porous polymer beads Tenax GC (for use as packing material in gas chromatography), and then, separated therefrom by using a gas chromatographic mass spectrometer. The separated gaseous organic substances were determined by an ion multiplier. Only below 10 ppb of toluene were detected by the analysis.

COMPARATIVE EXAMPLE 1

Following a procedure similar to that employed in EXAMPLE 1, finely divided toner particles were prepared from 46 parts of the same bisphenol A/epichlorohydrin type epoxy resin as that used in Example 1, 46 parts of a styrene/n-butyl acrylate copolymer having a weight average molecular weight of about 60,000 and a melting point of 140° C. ("Hymer SBM"-600, trade name, supplied by Sanyo Chemical Co.) and 6 parts of Nigrosine Black EX.

Using these finely divided toner particles, letter copies were produced in a manner similar to that employed in EXAMPLE 1. Upon flash fixation of the developed toner image, an offensive odor was emitted. By analysis of the gaseous organic substances evolved, 20 to 30 ppb of styrene, trichloroethylene, xylene, isobutyl acetate, butyl acrylate and methyl acrylate were detected.

EXAMPLE 2

Following a procedure similar to that employed in EXAMPLE 1, finely divided toner particles were prepared from 93 parts of a bisphenol A/epichlorohydrin type epoxy resin having an epoxy equivalent of about 950, a weight average molecular weight of about 1,400 and a melting point of about 100° C. ("Epikote 1004", trade name, supplied by Shell Chemical Co.), 5 parts of the same carbon black powder as that used in EXAMPLE 1 and 2 parts of Nigrosine Black EX. Using these finely divided toner particles, letter copies were produced in a manner similar to that employed in EXAMPLE 1. Upon flash fixation of the developed toner image, only a negligible amount of offensive odor was emitted. The chart of the gas chromatographic mass spectrometry of the gaseous organic compounds generated is illustrated in FIG. 1, wherein peaks a, d, e and g signify air, methyl isobutyl ketone, toluene and xylene, respectively.

EXAMPLE 3

Following a procedure similar to that employed in EXAMPLE 1, finely divided toner particles were prepared from 83 parts of a bisphenol A/epichlorohydrin type epoxy resin, 5 parts of a carbon black powder, 2 parts of Nigrosine Black EX and 10 parts of a montanic acid ester wax (Ester Wax E, supplied by Hoechst A. G., this wax has a dropping point of 79 to 85, an acid number of 15 to 20, a saponification number of 130 to 160 and a density of 1.01 to 1.03 g/cm$^3$). The epoxy resin, the carbon black powder and the Nigrosin Black EX were the same as those used in EXAMPLE 2. Using these finely divided toner particles, letter copies were produced in a manner similar to that employed in EXAMPLE 1. Upon flash fixation of the developed toner image, only a negligible amount of offensive odor was emitted. The gaseous organic compounds detected were similar to those mentioned in EXAMPLE 1. Even when thirty thousand copies were produced, the printed image was clear and no fog formation was observed in the background area. In contrast, when thirty thousand copies were produced using the toner particles of EXAMPLE 2, the printed image became unclear, fog formation was observed in the background area and incomplete image transfer was observed.

COMPARATIVE EXAMPLE 2

Figure 2:
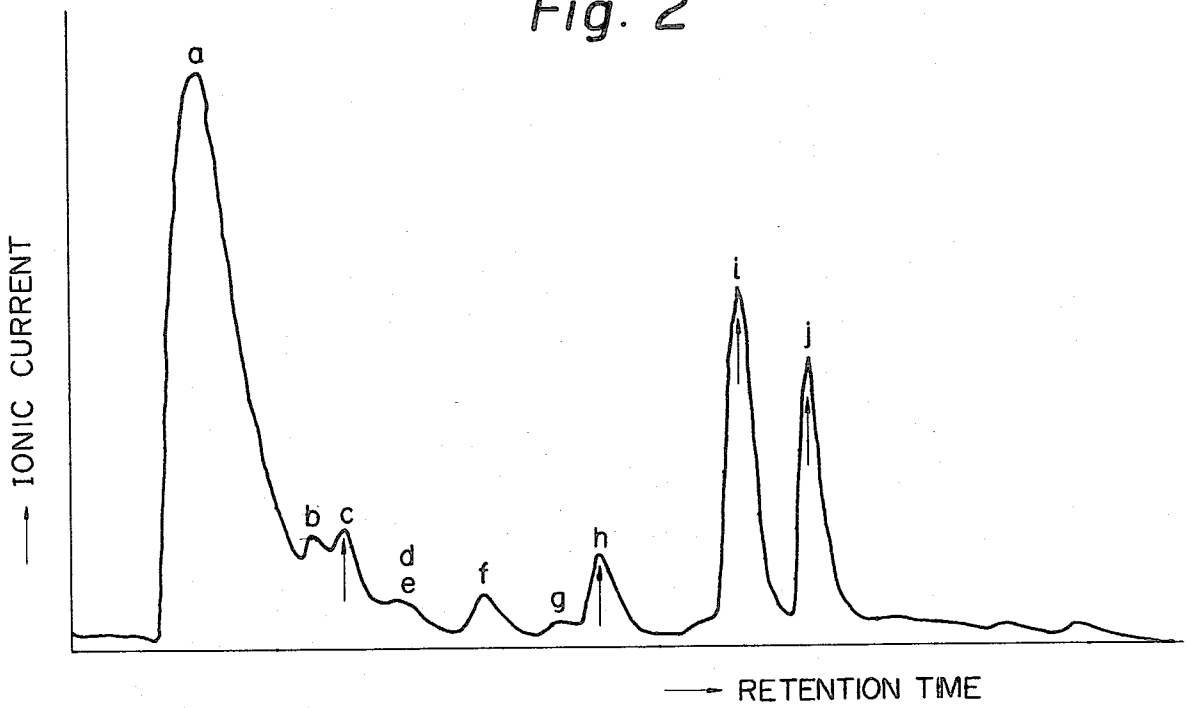
FIG. 2 illustrates a gas chromatogram of a gaseous mixture evolved when an image developed with a conventional toner comprising a styrene/butyl acrylate copolymer is fixed by means of flash fixation.

Following a procedure similar to that employed in EXAMPLE 3, finely divided toner particles were prepared wherein a styrene/n-butyl methacrylate copolymer ("Hymer SBM"-73, trade name, supplied by Sanyo Chemical Co.) was used as a binder resin instead of the bisphenol A/epichlorohydrin type epoxy resin. All other conditions remained substantially the same. Using these toner particles, letter copies were produced in a manner similar to that employed in Example 3. Upon flash fixation of the developed toner image, an offensive odor was emitted. The chart of the gas chromatographic mass spectrometry of the gaseous organic compounds evolved is illustrated in FIG. 2, wherein the peaks signify low molecular weight compounds as follows. That is, a=air, b=n-butanol, c=methyl methacrylate plus trichloroethylene, d=methyl isobutyl ketone, e=toluene, f=isobutyl acetate, g=xylene, h=styrene, i=α-methylstyrene plus buthyl methacrylate and j=unidentified acrylic compounds. The arrows in FIG. 2 mean that the low molecular weight compounds corresponding to the peaks indicated by the arrows are sources of the offensive odor.

What we claim is:

1. An improvement in an electrophotographic process for developing an electrostatic latent image with finely divided toner particles and fixing the developed image by irradiating it with a high energy ultraviolet or visible light, said improvement comprising using as the toner particles those which consist essentially of, based on the weight of the toner particles, 0.6 to 8% by weight of carbon as a colorant and 0 to 50% by weight of a dye as a colorant, and 62 to 99.4% by weight of a binder resin; at least 95% by weight of said binder resin being a bisphenol A/epichlorohydrin type epoxy resin having a melting point of from 60° to 160° C., an epoxy equivalent of from about 450 to about 5,500 and a weight average molecular weight of from about 900 to about 8,250.

2. The process according to claim 1, wherein the bisphenol A/epichlorohydrin type epoxy resin has a melting point of from 80° to 120° C.

3. The process according to claim 1, wherein the amount of carbon is in the range of from 4 to 6% by weight based on the weight of the toner particles.

4. The process according to claim 1, wherein the amount of the dye is in the range of from 1 to 3% by weight based on the weight of the toner particles.

5. An improvement in an electrophotographic process for developing an electrostatic latent image with finely divided toner particles and fixing the developed image by irradiating it with a high energy ultraviolet or visible light, said improvement comprising using as the toner particles those which consist essentially of, based on the weight of the toner particles, 0.6 to 8% by weight of carbon as a colorant and 0 to 5% by weight of a dye as a colorant, 62 to 99.4% by weight of a binder resin, and about 1% to about 20% by weight of a montanic acid ester wax, at least 95% by weight of said binder resin being a bisphenol A/epichlorohydrin type epoxy resin having a melting point of from 60° to 160° C., an epoxy equivalent of from about 450 to about 5,500 and a weight average molecular weight of from about 900 to about 8,250.

* * * * *